United States Patent [19]

Roper, Jr. et al.

[11] 4,198,249

[45] Apr. 15, 1980

[54] STEEL SUBSTRATE FOR GLASSING

[75] Inventors: Charles R. Roper, Jr., Coatesville; Roy Hetherington, Jr., West Chester, both of Pa.

[73] Assignee: Lukens Steel Company, Coatesville, Pa.

[21] Appl. No.: 940,604

[22] Filed: Sep. 8, 1978

Related U.S. Application Data

[63] Continuation-in-part of Ser. No. 817,443, Jul. 2, 1977, abandoned.

[51] Int. Cl.[2] ..... B32B 15/04; C22C 38/12

[52] U.S. Cl. ..... 148/36; 75/123 J; 75/123 L; 427/376.5

[58] Field of Search ..... 148/12 C, 12 D, 12 F, 148/36, 127; 75/123 B, 123 J, 123 L, 123 N; 427/376 D

[56] References Cited

U.S. PATENT DOCUMENTS

| | | | |
|---|---|---|---|
| 3,282,685 | 11/1966 | Mayer | 75/123 J |
| 3,436,808 | 4/1969 | Kotyk | 427/376 D |
| 3,507,687 | 4/1970 | Laird | 427/376 D |
| 3,914,135 | 10/1975 | Kozasu et al. | 75/123 L |

FOREIGN PATENT DOCUMENTS

| | | | |
|---|---|---|---|
| 904728 | 8/1962 | United Kingdom | 427/376 D |
| 1103618 | 2/1968 | United Kingdom | 427/376 D |

*Primary Examiner*—L. Dewayne Rutledge
*Assistant Examiner*—Peter K. Skiff
*Attorney, Agent, or Firm*—Mason, Mason & Albright

[57] ABSTRACT

A low carbon glassing steel structure having a very fine grain structure used in glass coating applications without deterioration in strength and impact resistance after being subjected to multiple high temperature thermal cycles, the steel structure having a minimum Charpy V-Notch energy of 50 ft-lbs at −50° F. in both the longitudinal and transverse directions and a minimum tensile strength of 60 KSI, an ASTM ferrite grain size of eight or finer, and the following composition:

| ELEMENT | PERCENTAGE BY WEIGHT |
|---|---|
| Carbon | up to 0.10 percent |
| Manganese | 0.45–1.25 percent |
| Silicon | 0.20–0.65 percent |
| Niobium | 0.02–0.06 percent |
| Iron and incidental Impurities | Balance |

7 Claims, No Drawings

STEEL SUBSTRATE FOR GLASSING

RELATED APPLICATIONS

This is a continuation-in-part of our application Ser. No. 817,443 filed July 2, 1977, abandoned.

BACKGROUND OF THE INVENTION

The invention relates to a steel substrate structure which receives glass coatings and, in particular, it relates to a substrate steel plate compatible with glass or ceramic coating methods utilizing elevated temperature processing or firing cycles. The term "glassed steel" refers to a composite material with a substrate structure which is at least 3/16" in thickness and a glass or ceramic coating approximately 0.035 to 0.075" thick.

Glassed steel structures, which are generally constructed with shaped steel plates as substrates, are frequently used in process vessels for the chemical, petrochemical, pharmaceutical and food processing industries. Coatings prepared from silicate frits, with or without additives, have the greatest industrial usage. Variations in composition of silicate frits are virtually unlimited; frits range from alkali-alumina borosilicate glasses, which are relatively soft (low-melting) and highly fluxed, to barium crown glasses. Crystallized ceramic coatings wherein the crystallization of the glass is controlled by formulation and heat treatment and by the presence of nucleating agents which are added to the glass during melting are also known.

Chemical compatibility of the glass coating with the substrate steel is important and further the coating must also be physically compatible with the underlying metal structure so that undesirable mechanical stresses are not induced in either material during thermal processing.

The best combination of glass (or ceramic) and metal is obtained when the glass has a slightly lower coefficient of thermal expansion than the metal substrate. This "controlled mismatch" results in the glass coating being in a state of compression after cooling which is important since these coatings are much stronger in compression than in tension.

Coating processes include heat treatment to promote bonding and sealing. While cooling from such heat treatment, it is important than an unacceptable mismatch not occur in the expansion of the substrate relative to that which the coating will endure during phase transformation of the substrate. Therefore, there should be no lower temperature transformation products such as bainite or martensite formed in the steel substrate. If these products occur, cracking or crazing of the glass coating is likely due to severe expansion of the steel substrate at temperatures where the glass coating is not sufficiently plastic to endure the strain.

Coatings are usually applied by wet spray, hot dusting, or dipping methods. Before application by any method, the substrate metal surface should be clean and rough. Abrasive blasting is normally utilized to provide a satisfactory surface condition. Other surface preparation steps may be involved. Finally, in the application, the substrate metal receives a number of coatings with firing after each coating at temperatures up to about 1700° F. Thus, for a quality product, it is essential that the steel substrate have physical characteristics whereby: (1) it will undergo the various steps utilized in the glassing process; (2) it does not promote cracking or crazing of the glass coating; (3) it provides an adequate structural support for the glass coating considering the ultimate use of the product; and (4) it does not deteriorate with the various heat treatments and other steps necessary for applying the glass to the steel substrate.

It is known to provide steel substrates for glassing processes which are relatively free of carbon, that is a low carbon steel plate or a steel plate in which the carbon has been stabilized by the addition of titanium such as ASTM A562 steel. ASME Code-approved carbon steels which are currently being used for glassing applications are known by the following ASME numbers: SA285 Gr. B, SA515 Gr.65, and SA516 Gr. 70. However, substrate structures composed of these steels are somewhat limited as to their ability to be successfully glassed without defects in the coating. Therefore, a need has existed for a better substrate steel which is more "glassable" than existing steels for both currently used and advanced coatings. In addition, improved mechanical properties of plate form the steel are desired, particularly notch toughness in the range of −20 to −50° F., in both the longitudinal and transverse directions, such quality to exist after a plurality of heat treating cycles necessary to fuse the glass and bond it to the metal.

The following publications will aid in an understanding of the background of the invention:

Smith, Robert E., "Ceramic-Metal Composites," Chemical Engineering, May 10, 1965, pp. 194–200.

Dormer, George J., Norton, George R., and Payne, Burton S., "Glassing Characteristics of Low-Alloy Steels," Journal of the American Ceramic Society, Vol. 44, No. 8, Aug. 1961 pp. 375–381.

Payne, Jr., B.S., "Nucerite—A New Composite," Chemical Engineering Progress, Vol. 64, No. 2, February, 1968, pp. 40–43.

SUMMARY OF THE INVENTION

The invention is a new steel substrate structure exclusively for glass and ceramic coating applications, the composition of the substrate providing excellent glassing characteristics known as glassability. Such steel substrates have been successfully tested using both current and advanced glass coating techniques wherein a number of heat treatments and coatings are applied in series. Further, after the required thermal glassing cycles have been completed the mechanical properties of the new steel substrate—particularly its toughness—remain unimpaired and are advantageous for ultimate uses to which the glassed steel structure may be subjected. The new steel substrate has low carbon content (0.10 percent maximum), a relatively high silicon level for glassing steels (0.20–0.65 percent) and a niobium addition (0.02–0.06 percent) to produce both good glassability and desirable mechanical properties in the steel substrate. The niobium addition causes the formation of precipitates in the steel substrate which insures a fine grain size and results in good mechanical properties after glassing. Silicon and manganese levels provide a relatively high transformation temperature range in the substrate to protect the glass coating from being crazed or cracked. The substrate is composed of a killed steel produced to fine grain practice. The resulting ASTM ferrite grain size number is about eight and finer.

DESCRIPTION OF THE PREFERRED EMBODIMENT

The steel substrate structure of the instant invention is exclusively for glass or ceramic coating applications and, more particularly, for glass coating applications wherein the glass or ceramic is applied in a series of coatings and undergoes a number of thermal cycles which heat the steel-glass system up to about 1700° F. The glass is preferably applied to the steel substrate, after its surface has been appropriately prepared, by wet spraying or hot dusting whereby a number of thin glass coatings one on top of the other are applied.

Although the finished product may be used for a variety of applications, the primary uses are in process vessels for the chemical industry where corrosion is a problem and for the food and pharmaceutical industries where product purity is a concern. The product may be subjected to low temperatures and required to support substantial weight in use. Thus, the strength and notch-toughnes of the product at low temperatures are an important factors to be considered in addition to those incident to a successful glassing operation as outlined above.

Prior experience has taught that a severe compromise must be made between strength and glassability of a steel substrate structure in the manufacture of glasses steel equipment. Low carbon steel structures available for this purpose have had good glassability but low strength. Higher strength steel structures with more carbon have exhibited both undesirable carbon reaction and hydrogen defects in te glass coating. Steel structures with high levels of titanium added to tie up carbon have had good glassability and freedom from hydrogen induced defects, but have been relatively expensive. From this background it is considered that a preferred substrate steel is one which has relatively low carbon, which does not undergo adverse phase transformations below the temperature at which the glass has hardened, and which will not have excessive grain growth after repeated firings thereby exhibiting low tensile and impact strength. Further, these virtues must exist in an economical carbon steel structure.

It occurred to the inventors that a solution to this problem might be presented by a substrate steel produced to fine grain practice having the following composition:

| ELEMENT | PERCENTAGE BY WEIGHT |
|---|---|
| Carbon | up to 0.10 percent |
| Manganese | 0.45 to 1.25 percent |
| Silicon | 0.20–0.65 percent |
| Niobium | 0.02–0.06 percent |
| Phosphorus | 0.035 percent maximum |
| Sulfur | 0.040 percent maximum |
| Iron | Balance |

Substrates from several heats of a killed steel produced to fine grain practice within the above composition limits were tested. It was found that the transformation temperature range was sufficiently high that with the glass-metal system at such temperatures the glass was plastic. A highly sensitive glass coating produced on such steel substrates were without significant cracking or crazing and the mechanical properties of the steel substrates wer not adversely affected by repeated thermal cycles utilized in the glassing process. The steel substrates of the products remained of a fine grain structure and displayed improved toughness in both the transverse and longitudinal modes.

The chemistry and mechanical properties after glassing are presented in Tables I and II respectively for material prepared from 150 lb. laboratory heats of the new steel substrate compositions. It will be noted that high strength and unusual low-temperature toughness were obtained, the fine ferrite grain size being maintained through the thermal glassing cycles.

TABLE I

| | Chemistry of Laboratory Heats | | | | | | |
|---|---|---|---|---|---|---|---|
| Heat | C | Mn | S | P | Si | Al | Nb |
| B268 | 0.08 | 0.55 | 0.020 | 0.011 | 0.58 | 0.032 | 0.038 |
| B269 | 0.08 | 1.07 | 0.021 | 0.013 | 0.32 | 0.038 | 0.038 |
| B278 | 0.07 | 0.61 | 0.017 | 0.020 | 0.61 | 0.058 | 0.039 |

TABLE II

| | Mechanical Properties after Thermal Glassing Cycles | | | | |
|---|---|---|---|---|---|
| Heat | Yield Point (KSI) | Ultimate Tensile Strength (KSI) | Charpy V-Notch Energy at −50° F. (Longitudinal) (ft-lbs) | Gage (In) | ASTM Ferrite Grain Size # |
| B268 Plate | 48.4 | 62.5 | 258 | ¾ | 8 |
| B269 Plate | 45.1 | 64.1 | 242 | ¾ | 9 |
| B278 Forged Bar | 41.6 | 63.1 | 262 | ¾ × ¾ cross sect. | 8 |
| Forged Bar | 41.6 | 63.0 | 144 (circumferential) | 2-12 × 3 cross sect. | 8 |

The continuity of the coating was complete and no evidence of oxidation of the substrate metal was observed. Cracks, pits and similar discontinuities in the coated surface were absent. The bond strength of the glass to the substrate was wholly satisfactory. In summation, an excellent commercially acceptable glass coating was obtained with the steel substrate of the invention using advanced glass coating techniques. Further, the low temperature notch toughness of the steel was much superior to currently used steels for the same purpose following the thermal glassing cycles.

Subsequent tests performed on production substrate steels after glassing largely confirmed the physical characteristics obtained in the above laboratory test results. Tables III and IV relate to substrate steels which were rolled into plate and glass coated. Minimum yield and tensile strengths of the steel substrates after glassing were found to be 30 ksi and 60 ksi respectively. Thus, the yield strength in the substrates of the glassed-steel products was somewhat lower, but not unacceptably so, than that obtained in the laboratory specimens. However, it was clear that a minimum Charpy V-Notch energy of fifty foot-pounds at −50° F. was obtainable in both the longitudinal and transverse directions of the substrate plate. This is an important and unusual characteristic inasmuch a the notch energy in the transverse direction of the plate usually reflects a reduced toughness relative to the longitudinal direction.

Although we have described the preferred embodiments of our invention, it should be understood that it is capable of other adaptations and modifications whereby the claims should be construed not only to cover the material described in the specification but also equivalents thereof.

TABLE III

| Heat | C | Mn | S | P | Si | Al | Nb |
|---|---|---|---|---|---|---|---|
| B0068 | 0.09 | 0.62 | 0.018 | 0.007 | 0.48 | 0.060 | 0.043 |
| B0137 | 0.06 | 0.57 | 0.020 | 0.007 | 0.41 | 0.033 | 0.03 |
| 23298-1 | 0.08 | 0.75 | 0.005 | 0.013 | 0.54 | 0.036 | 0.049 |

TABLE IV

| | Mechanical Properties after Thermal Glassing Cycles | | | | | | | | |
|---|---|---|---|---|---|---|---|---|---|
| | Yield Point | Ultimate Tensile Strength | Charpy V-Notch Energy (ft-lbs) | | | | | | |
| | | | −50° F. | | −75° F. | | −110° F. | | |
| Heat | (ksi) | (ksi) | L | T | L | T | L | T | Gage (inch) |
| B0068 Plate | 39.2 | 63.2 | 69 | 61 | 48 | 30 | 7 | 4 | 1 |
| B0137 Plate | 38.7 | 60.0 | 257 | 75 | 260 | 28 | 19 | 10 | 1 |
| 23298-1 Plate | 31.6 | 63.4 | 73 | 90 | 36 | 109 | 21 | 10 | 11/16 |

Having thus described our invention, what we claim as new and desire to secure by Letters Patent of the United States is:

1. A low carbon glassing steel structure having a very fine grain structure for use in glass coating applications without deterioration in strength and impact after multiple high temperature thermal cycles, said steel structure composed of:

| ELEMENT | PERCENTAGE BY WEIGHT |
|---|---|
| Carbon | up to 0.10 percent |
| Manganese | 0.45–1.25 percent |
| Silicon | 0.20–0.65 percent |
| Niobium | 0.02–0.06 percent |
| Iron and incidental impurities | Balance; |

said steel structure having an ASTM ferrite grain size of about 8 or finer, a yield point in excess of 30000 psi and an ultimate tensile strength in excess of 60000 psi, and a minimum Charpy V-Notch energy of 50 foot-pounds at −50° F. in both the longitudinal and transverse directions of the structure, and after being subjected to said thermal cycles.

2. A low carbon steel structure in accordance with claim 1 with a glass coating thereon wherein said glass is plastic in the transformation temperature range of said steel.

3. A low carbon steel in accordance with claim 1 which contains a maximum of 0.035 percent phosphorus and 0.040 percent sulfur.

4. A low carbon steel structure in accordance with claim 1 which contains a maximum of about 0.015 percent phosphorus and about 0.015 percent sulfur.

5. A low carbon steel plate in accordance with claim 1 which is utilized in a process wherein glass coatings are provided thereon with little or no deterioration in impact resistance of said plate as a result of the process, said process including thermal cycling heat treatments of the steel plate with glass applied thereto up to about 1700° F.

6. A low carbon glassing steel substrate plate for use in glass coating applications involving multiple thermal cycles at temperatures up to 1700° F. with little or no deterioration in strength and impact resistance resulting therefrom, said steel substrate having the following composition:

| ELEMENT | PERCENTAGE BY WEIGHT |
|---|---|
| Carbon | up to 0.10 |
| Manganese | 0.45–0.80 |
| Silicon | 0.30–0.65 |
| Niobium | 0.02–0.06 |
| Aluminum | 0.03–0.06 |
| Sulfur | up to 0.02 |
| Phosphorus | up to 0.015 |
| Iron and incidental impurities | Balance; |

said steel substrate plate having an ASTM ferrite grain size of eight or finer, a minimum yield point of 30 ksi, an ultimate tensile strength of 60 ksi, and a minimum Charpy V-Notch energy of 50 foot-pounds at −50° F. in both the longitudinal and transverse directions, after having been subjected to said thermal cycles.

7. A low carbon steel plate in accordance with claim 6 wherein the plate is at least 3/16″ in thickness.

* * * * *